US009259095B2

(12) United States Patent
Lamke

(10) Patent No.: US 9,259,095 B2
(45) Date of Patent: Feb. 16, 2016

(54) ONE PIECE CAMP COT

(71) Applicant: HKD Global Limited, North Point (HK)

(72) Inventor: Samuel F. Lamke, Washington, MO (US)

(73) Assignee: HKD Global Limited, Hong Kong (HK)

( * ) Notice: Subject to any disclaimer, the term of this patent is extended or adjusted under 35 U.S.C. 154(b) by 0 days.

(21) Appl. No.: 14/679,795

(22) Filed: Apr. 6, 2015

(65) Prior Publication Data

US 2015/0282629 A1 Oct. 8, 2015

Related U.S. Application Data

(60) Provisional application No. 61/975,277, filed on Apr. 4, 2014.

(51) Int. Cl.
*A47C 17/72* (2006.01)
*A47C 19/12* (2006.01)

(52) U.S. Cl.
CPC ..... *A47C 17/72* (2013.01); *A47C 19/126* (2013.01)

(58) Field of Classification Search
CPC ..... A47C 17/72
USPC ..... 5/110–114, 116
See application file for complete search history.

(56) References Cited

U.S. PATENT DOCUMENTS

2012/0047649 A1* 3/2012 Grace ..... 5/110

* cited by examiner

*Primary Examiner* — Fredrick Conley
(74) *Attorney, Agent, or Firm* — Polster Lieder

(57) ABSTRACT

An improved sleeping or camping cot construction is provided which eliminates the need for end rails for the cot frame. The frame is all one piece, portions of which are pivotally mounted with respect to other portions to permit folding of the frame for storage. A locking mechanism is associated with at least one of the cot supporting cross members to maintain the cot in the user supporting position of the cot.

6 Claims, 3 Drawing Sheets

ONE PIECE CAMP COT

This application claims priority to U.S. provisional application Ser. No. 61/975,277 filed Apr. 4, 2014, the specification of which is incorporated herein by reference.

STATEMENT REGARDING FEDERALLY SPONSORED RESEARCH

Not Applicable.

BACKGROUND OF THE INVENTION

This invention relates to camping equipment and more particularly, to cots which may be disassembled into a small lightweight package. While the invention is described in particular detail with respect to use in a camping environment, those skilled in the art will recognize the wider applicability of the inventive principles disclosed hereinafter.

The statements in this section merely provide background information related to the present disclosure and may not constitute prior art.

Portable cots have been known for many years. The typical light weight camp cot includes a rectangular body or frame supporting a sheet; the body typically including a pair of long opposed side rails and a pair of opposed end rails which together with the side rails support the sheet.

There are prior art constructions that have been developed in an attempt to fashion a low-cost cot design which will support the user properly, and yet can be disassembled and carried in a compact package between cot setups. Conventionally, the side rails of the cot are formed in two pieces, which are disassembled or folded for transporting the cot. In some prior art designs, the end rails themselves were detachable from the side rails for a similar purpose.

Because certain portions of the supporting frame are detachable from others, it is not unusual for the end user to lose or misplace portions of the supporting frame over time, making the cot nonfunctional. The present assignee is also the owner of U.S. Pat. No. 8,528,131 (the "'131 patent") which provides a method to keep the end rails attached to the side rails. The disclosure of the '131 patent is incorporated herein by reference. While the '131 patent works well for its intended purpose, the construction and design of the cot provides a somewhat more difficult procedure for assembling and disassembling the cot described hereinafter, particularly when only one person is available to assemble the cot for use and later disassemble or fold the cot for transportation or storage.

I have found for example, that end rails for the cot may be eliminated in their entirety, provided a mechanism is provided to maintain the cot in its bed sheet supporting position during use while permitting the frame to be folded for storage.

The embodiment disclosed hereinafter provides a simple mechanism for cot set up, while eliminating the need for end rails connected to other frame members so that the entire structure of the cot is foldable into a compact package for storage and/or transportation.

SUMMARY OF THE INVENTION

In accordance with this disclosure, generally stated, a portable, collapsible cot construction is provided with a frame which is easily foldable for a user. The construction enables the structural components forming the cot frame to remain attached in a manner enabling the frame to be compacted into a relatively small bundle. In the preferred embodiment, the frame includes side rails and cross bar supporting members attached to the respective side rails, and eliminates the need for end rails to maintain the cot in a user supporting position. The construction permits the side rails, which are enclosed and protected by the fabric of the body support sheet, to fold in a manner so that the fabric will fold itself which can be rolled up as a compact bundle of relatively small diameter having a length approximately half the of the length dimension of the cot in its un-collapsed body supporting condition.

The foregoing and other objects, features, and advantages of the invention as well as presently preferred embodiments thereof will become more apparent from the reading of the following description in connection with the accompanying drawings.

BRIEF DESCRIPTION OF THE SEVERAL VIEWS OF THE DRAWINGS

In the accompanying drawings which form part of the specification.

Corresponding reference numerals indicate corresponding parts throughout the several figures of the drawings.

DESCRIPTION OF THE PREFERRED EMBODIMENT

The following detailed description illustrates the invention by way of example and not by way of limitation. The description clearly enables one skilled in the art to make and use the invention, describes several embodiments, adaptations, variations, alternatives, and uses of the invention, including what is presently believed to be the best mode of carrying out the invention.

Figure 1:
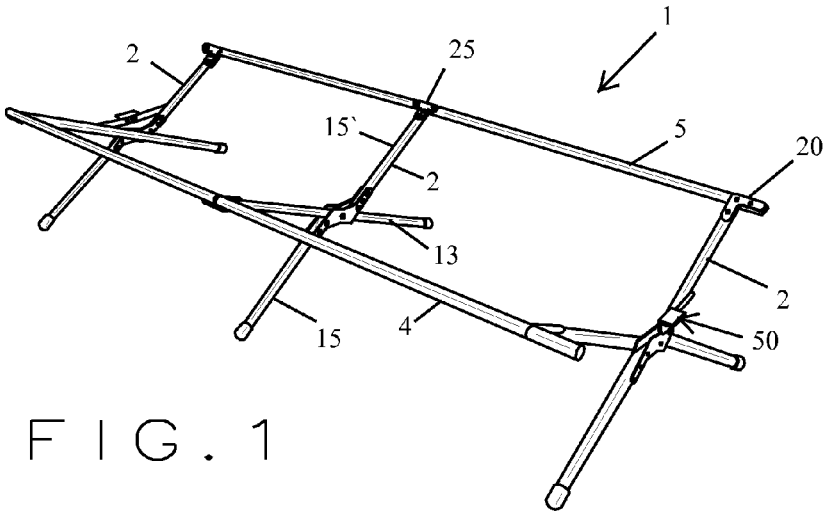
FIG. 1 is a view in perspective of one illustrative embodiment of cot frame construction of the present disclosure, shown in its normal body supporting position.
Figure 2:
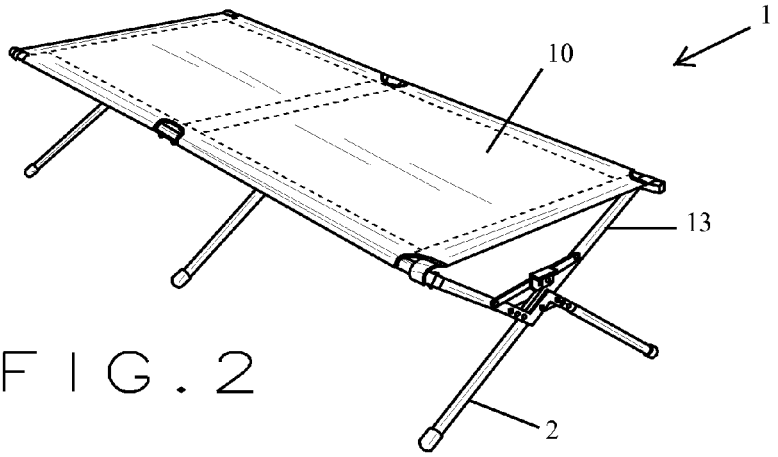
FIG. 2 is a view in perspective of the cot frame shown in FIG. 1 with suitable bed sheet fabric attached.

Referring now to FIG. 1, reference numeral 1 indicates one illustrative embodiment of cot of the present disclosure. The cot 1 includes a plurality of support struts 2 which in turn are interconnected to respective ones of a pair of side rails 4 and 5. A bed sheet 10 extends along and is supported by the side rails 4 and 5 of the cot 1. A particular feature of the present disclosure is the elimination of end rails extending between the respective ends of the side rails 4 and 5 conventionally employed in cot constructions of the prior art.

Figure 4:
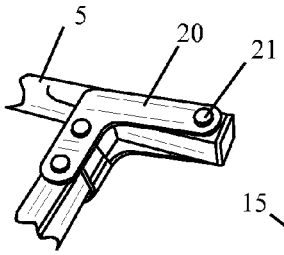
FIG. 4 is a view in perspective partly broken away illustrating the corner hinge detail of the connection of the support members with the side rails of the present disclosure.
Figure 5:
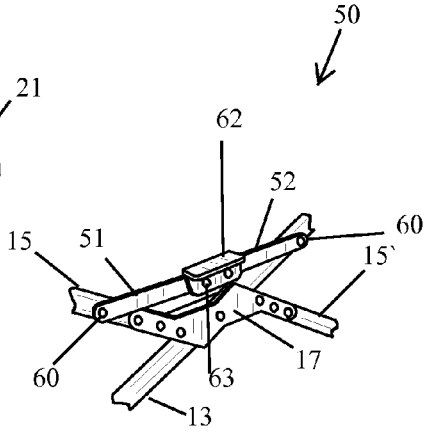
FIG. 5 is a view in perspective of the center handle locking mechanism assembly connected between the respective parts of a support member for the side rails of the present disclosure.

Each support strut 2 includes a one piece member 13 and a split member 15 and 15'. The members 13, 15 and 15' are interconnected to one another by a z-shaped bracket 17. The bracket 17 permits the split members 15 and 15' to close toward one another in the storage position of the cot 1, for example. As will be appreciated by those skilled in the art, the length of the various members can be altered or changed in order to vary the height of the cot 1 from a supporting floor or ground position. The member 13 and the split member 15' each also are attached to the respective side rail 4 or 5 by an L-shaped bracket 20 (FIG. 4) which is pivotally attached to the respective side rails at a pivot point 21, permitting the support struts 2 to be rotated against the respective side rails in the stored or carried position of the cot 1.

While the number of struts 2 used for support of the cot 1 may vary in other embodiments of the invention, a three strut 2 arrangement works well for the embodiment of FIG. 1. As will be appreciated by those skilled in the art, the construction arrangement of the struts 2 preferably are the same for each of the struts 2 employed with the cot 1, the intention being to permit the cot 1 to be folded simply into a relatively light weight carry package for use by campers or others who might require easy set of sleeping accommodations. One of the features of the side rails 4, 5 and strut 2 construction is that the more weight placed on bed sheet 10, for example, the more the weight acts to maintain the cot 1 in an unfolded or extended position, thereby added to the stability of the cot 1 in application use.

Figure 3:
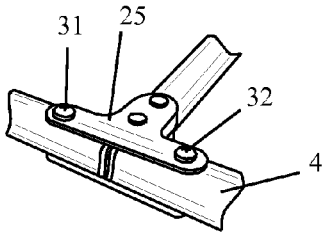
FIG. 3 is a view in perspective partly broken away illustrating the middle hinge detail employed with the side rails for the embodiment of FIG. 1.

As shown in the FIGS. 1 and 3, each of the side rails 4 and 5 are arranged in two parts which are in are connection to one another and are rotatably mounted with respect to one another along a bracket 25. The bracket 25 in the preferred embodiment also is arranged to mount one of the struts 2. That is to say, each part of side rails 4 and 5 may be rotated toward one another along the bracket 25, which preferably bisects each of the side rails 4, 5 in the embodiment of FIG. 1. Each of the side rails 4, 5 and the bracket 25 are attached to the respective sections of the end rails along pivot points 31 and 32. Conventional fasteners may be used to provide a pivoting motion, but those skilled in the art will recognize that other techniques will be employed if desired.

At least one of the struts 2 has a releasable locking mechanism 50 associated with it. The mechanism 50 includes a first arm 51 pivotally mounted to one of the split members 15, 15' and a second arm 52 pivotally mounted to the one piece member 13. Preferably the attachment of the arm 51 to the split member 15, 15' is made to the split member which is attached to a side rail of the cot 1. Attachment of the arms 51 and 52 each have a first end which is attached to their respective strut 2 members along a pivot 60 respectively. As will be appreciated, the pivots can be accomplished by a number of methods. Conventional threaded fasteners or rivet connections work well, for example.

The arms 51 and 52 each in turn have a second end which is pivotally attached to a handle release 62 at pivot points 63. As shown in the drawings, the handle release 62 preferably is positioned equidistant from the respective first ends of the arms 51 and 52. As indicated above, a downward force on the bed sheet 10, for example, tends to keep the mechanism 50 in its extended position until intentionally released by a user when storage of the cot 1, for example is required or desired.

As will be appreciated by those skilled in the art, the bed sheet 10 may be attached to the side rails 4 and 5 by any convenient method. Hook and loop fasteners work well, for example. A particular feature of the present disclosure is that the bed sheet 10 may be attached to or removed from the side rails easily for cleaning, for example, or left in place during storage.

Figure 6C:
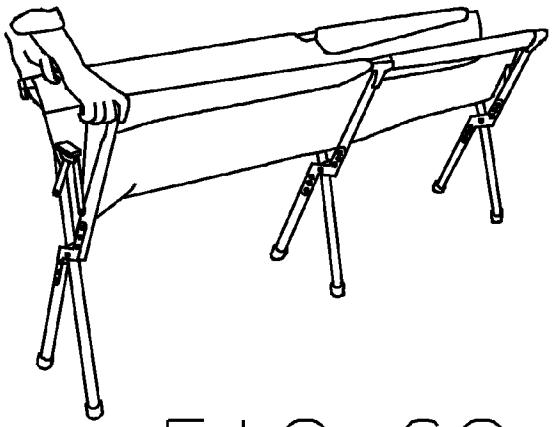
FIGS. 6 (A) through 6 (J) are views in perspective showing the folding sequence of the cot shown in FIG. 1.
Figure 6B:
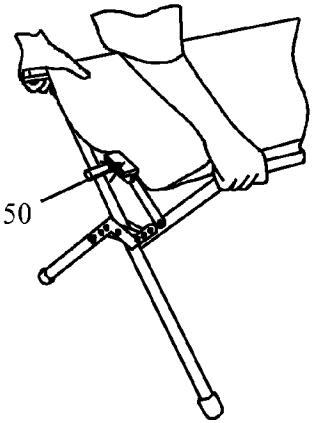
Figure 6A:
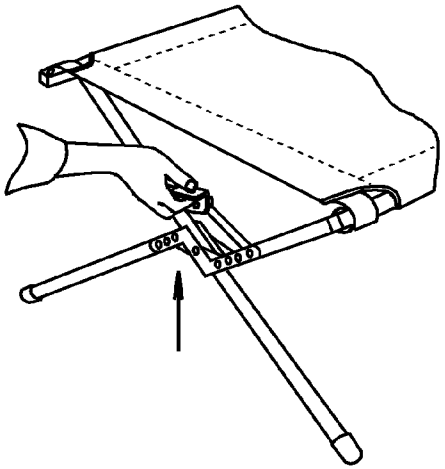
Figure 6E:
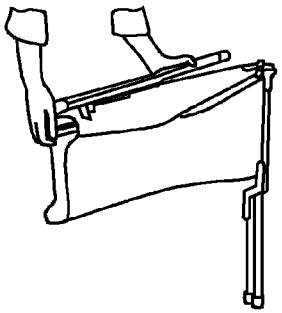
Figure 6D:
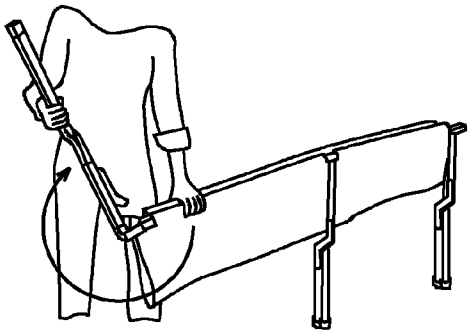
Figure 6F:
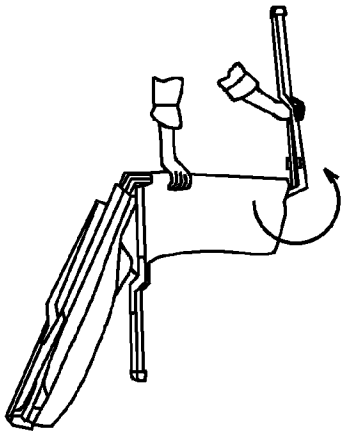
Figure 6G:
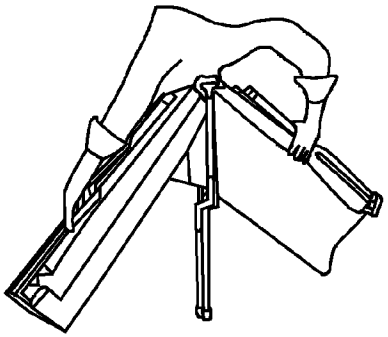
Figure 6I:
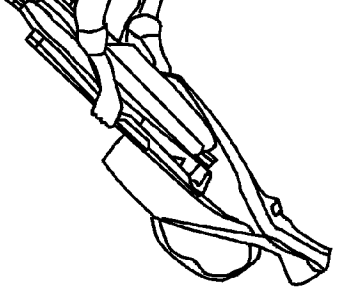
Figure 6J:
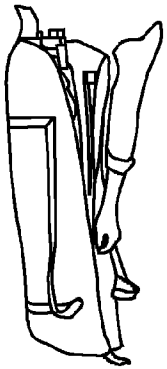
Figure 6H:
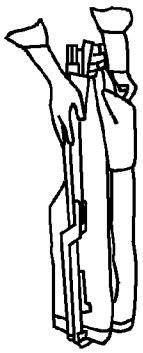

The folding operation of the cot 1 is shown in FIGS. 6A thru 6J. As there shown, the mechanism 50 is moved upwardly to permit the struts 2 to be folded toward one another as shown in FIG. 6C. The cot 1 is then rotated as shown in FIG. 6D to bring the struts 2 adjacent the side rails 4 and 5. The side rails are then pivoted toward the center strut 2 as shown in FIG. 6G and the bed sheet is wrapped around the collapsed frame. The collapsed cot 1 then is inserted in a suitable storage bag or case as shown in FIG. 6J, preferably provided to carry the cot between intended uses.

In view of the above, it will be seen that the several objects of the invention are achieved and other advantageous results are obtained. As various changes could be made in the above constructions without departing from the scope of the invention, it is intended that all matter contained in the above description or shown in the accompanying drawings shall be interpreted as illustrative and not in a limiting sense. Merely by way of example, other pivoting and/or rotating arrangement for the release and its relationship to the side rails will occur to those skilled in the art. As indicated, the dimensions of the cot 1 may be varied. These variations are merely descriptive.

The invention claimed is:

1. A cot having a frame for supporting a bed sheet, comprising:

a pair of opposed side rails;

a bed sheet removably attached to said pair of opposed side rails;

a plurality of supporting members pivotally mounted to the opposed side rails, at least one of the supporting members having a split member and one piece member, the split member being attached to one of the opposed side rails; and a locking mechanism associated with at least one supporting member to permit movement of the supporting member between a first stored position and a second locked position in supporting relationship with said opposed side rails, the locking mechanism including first arm having a first end pivotally mounted to one of the split members and the second arm having a first end pivotally mounted to the one piece member, the arms each having a second end pivotally mounted to a handle release, the handle release being positioned equidistant from each of the first ends of the respective first and second arms, such that as weight is applied to said bed sheet the more stable the frame becomes.

2. The cot of claim 1 wherein the bed sheet is attached to the side rails by hook and loop fasteners.

3. The cot of claim 1 wherein the actuating handle and first and second arms of the locking mechanism exert a force to prevent collapse of the associated supporting member in the cot supporting position of the supporting member.

4. In a cot having a pair of opposed side rails, a plurality of supporting members pivotally mounted to the opposed side rails, each supporting member including first and second struts defining the supporting member; and a bed sheet removably carried by said opposed side rails, the improvement which comprises a locking mechanism attached to at least one supporting member, the locking mechanism including a handle actuator, a first arm having a first end rotatably mounted to the handle actuator and a second end rotatably mounted to one of the first and second struts of the supporting member, and a second arm having a first end rotatably mounted to the handle actuator and a second end rotatably mounted to the other of the first and second struts of the supporting member, the handle actuator being positioned equidistant from the respective second ends of the first and second arms.

5. The improvement of claim 4 wherein the handle is T shaped in cross section.

6. The improvement of claim 4 wherein the handle is L shaped in cross section.

* * * * *